United States Patent [19]

Moore

[11] 3,983,775

[45] Oct. 5, 1976

[54] APPARATUS FOR INDENTING PANELS

[76] Inventor: Alfred A. Moore, 562 N. Burton Ave., San Gabriel, Calif. 91776

[22] Filed: Dec. 26, 1974

[21] Appl. No.: 536,366

[52] U.S. Cl. ..... 83/660; 83/1; 83/2

[51] Int. Cl.[2] ..... B26F 1/24

[58] Field of Search ..... 83/660, 2, 1

[56] References Cited

UNITED STATES PATENTS

| | | | |
|---|---|---|---|
| 134,214 | 12/1872 | Mellor | 83/660 |
| 2,322,726 | 6/1943 | Carfagno | 83/2 |
| 2,373,311 | 4/1945 | Holmes | 83/2 |
| 3,831,476 | 8/1974 | Noren | 83/2 |

*Primary Examiner*—Donald R. Schran
*Attorney, Agent, or Firm*—Boniard I. Brown

[57] ABSTRACT

A mounting clip having projecting prongs is installed along an edge of a wall panel, to permit attachment of the panel to a support member having means for mating engagement with the mounting clip, by driving the clip prongs into the panel edge either with or without prior indentation of the edge by driving similar prongs of an indenting tool into the edge. Pressure is applied to opposite sides of the panel adjacent its edge during penetration of the latter by the tool or clip prongs to prevent bulging of the panel sides.

18 Claims, 10 Drawing Figures

FIG. 1.
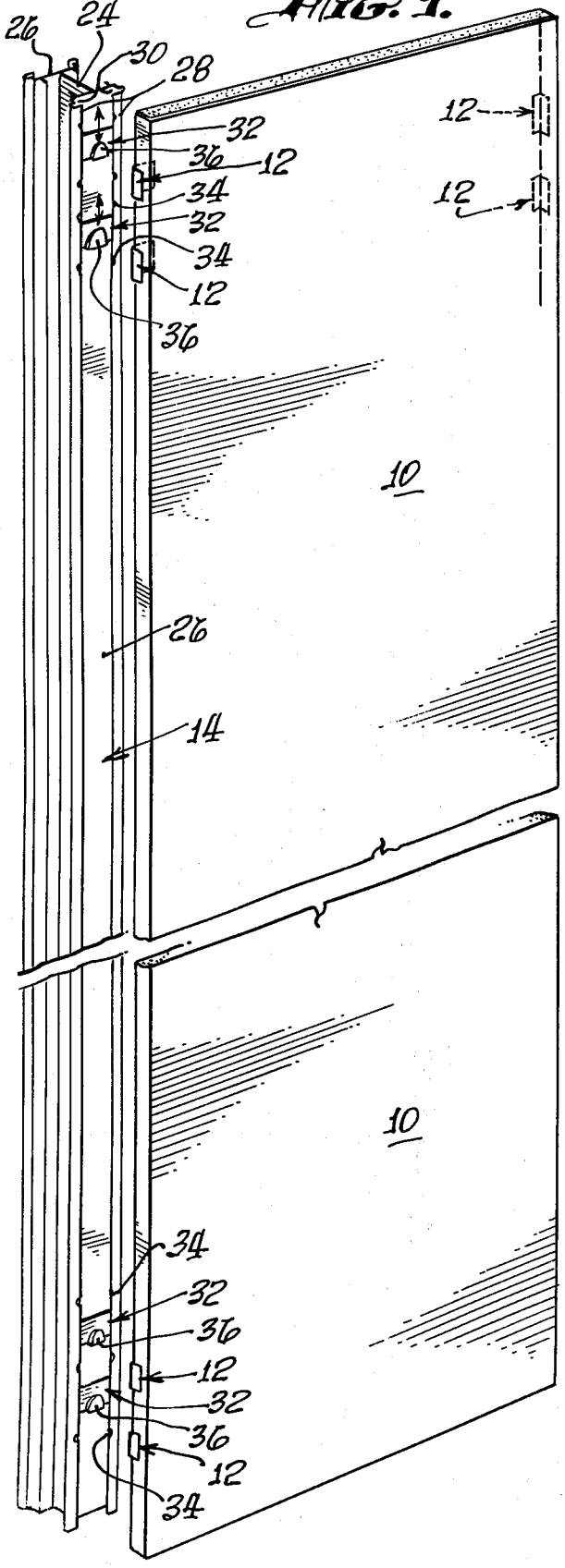
FIG. 2.
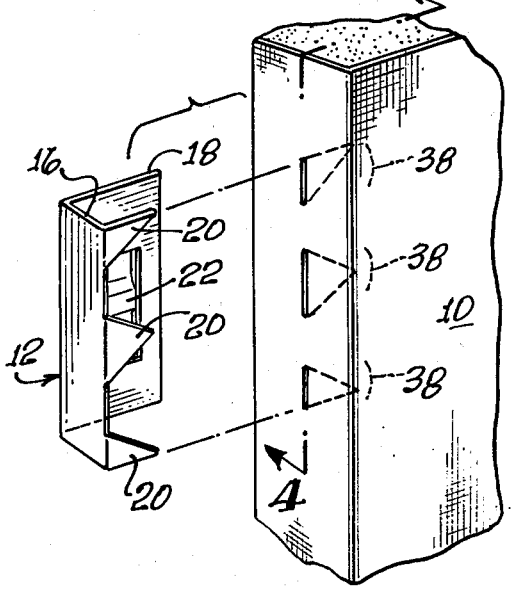
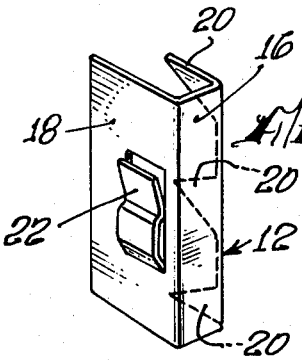
FIG. 3.
FIG. 4.
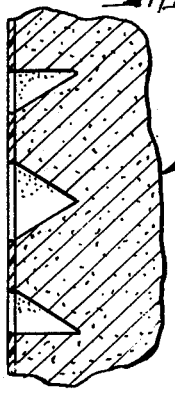

APPARATUS FOR INDENTING PANELS

BACKGROUND OF THE INVENTION

1. Field of the Invention

This invention relates generally to wall panels of the kind which are attached to upright support members by means of mounting clips on the panels having prongs which are driven into the panel edges to secure the prongs to the panels. The invention relates more particularly to a method of an apparatus for installing the mounting clips on the panels without bulging of the panel surfaces by displacement of the panel material as the prongs enter the panel edges.

2. Discussion of the Prior Art

Partitions or walls in office buildings and other structures are often constructed by attaching wall panels, such as gypsum panels with plastic facing sheets, to upright support members. The panels are attached to the support members by means of mounting clips on the panels, along their edges, which engage in interlocking relation adjustable mounting plates on the support members.

The panel mounting clips are generally channel shaped sheet metal parts having a web portion, a flange along one edge of the web portion, and prongs along the opposite edge of the web portion. The flange and prongs are disposed in parallel planes normal to the web portion and spaced a distance approximating one half the panel thickness. The width of the flange exceeds the length of the prongs, such that the flange has an edge portion projecting beyond the tips of the prongs. Each clip is installed in a panel by placing its prongs against an edge of the panel with the projecting portion of the clip flange seating against the rear side of the panel and driving the prongs into the edge.

This method of clip installation is unsatisfactory for the reason that as the prongs enter or penetrate the panel edge, they displace the panel material outwardly toward the panel sides. This displacement produces bulges in the panel surfaces which are quite visible and detract noticeably from the appearance of the finished partition or wall.

SUMMARY OF THE INVENTION

This invention provides a method and apparatus for installing mounting clips of the character described on a wall panel in such a way as to avoid bulging of the front panel surface. According to one aspect of the invention, this is accomplished by selecting a panel indenting tool having prongs similar to those of a panel mounting clip and driving these tool prongs into and from the edge of a wall panel to indent the edge where pressure is applied to the adjacent portions of the panel surfaces to prevent bulging of the front surfaces by the entering tool prongs. The prongs of a mounting clip may then be driven into the preformed edge indentations, on the job site for example, without bulging the panel sides. According to another aspect of the invention, a mounting clip is installed on a panel without indenting its edge by driving the clip prongs into the edge where pressure is applied to the panel sides to prevent bulging of the panel by the entering clip prongs.

According to another of its aspects, the invention provides a machine for practicing the above mounting clip installing procedures of the invention. This machine has a frame mounting at least one mechanism, referred to herein as a drive mechanism, which functions as a panel indenting mechanism or a mounting clip installing mechanism depending upon which procedure is to be practiced. The mechanism includes a drive head for holding a panel indenting tool or a mounting clip, as the case may be, with the tool or clip prongs disposed in a given plane of the frame and extending parallel to a given direction line in the plane and an actuator, such as a fluid powered ram, for extending and retracting the drive head parallel to the direction line. Also mounted on the frame are means for supporting a wall panel in a position wherein the panel is disposed on the clip plane with one side of the panel resting on the supporting means and one edge of the panel transferse to the direction line and facing the holder.

During operation of the machine, a panel indenting tool or a panel mounting clip is installed on the drive head and the latter is extended and retracted by its actuator. In the case of the panel indenting machine, such extension and retraction of the head drives the prongs of the indenting tool in the holder into and from the edge of the panel to indent the edge for subsequent installation of a panel mounting clip. In the case of the mounting clip installing machine, extension of the drive head drives the clip prongs into the panel edge to effect installation of the mounting clip on the panel. Retraction of the head separates the latter from the mounting clip, leaving the latter on the wall panel.

Each drive mechanism is equipped with a panel clamping mechanism which is operable in timed relation to the extension and retraction movement of the tool or clip drive head. This clamping mechanism includes a pressure member, such as a pressure plate, which is extended into contact with the exposed side of the wall panel concurrently with extension of the tool or clip drive head to effect penetration of the panel edge by the prongs of the indenting tool or mounting clip. The pressure member engages the panel in the region opposite the points of penetration of the edge by the prongs to prevent bulging of the panel side by the entering prongs. The pressure member is retracted from the panel to release the latter upon retraction of the drive head.

In the particular machines described, the panel supporting means include a conveyor for supporting wall panels for movement in succession through an indenting or clip installing position. The machines have indenting mechanisms or clip installing mechanisms, as the case may be, along each side of the path of movement of the panels for simultaneously indenting or installing mounting clips along opposite edges of the panels.

BRIEF DESCRIPTION OF THE DRAWINGS

FIG. 1 is an exploded perspective view illustrating a wall panel mounting arrangement including panel mounting clips of the kind which the present invention is concerned with from the standpoint of installation of the clips on the panel;

FIG. 2 is an enlarged fragmentary exploded perspective view of the panel and a mounting clip;

FIG. 3 is an enlarged perspective view of a mounting clip like that of FIG. 2;

FIG. 4 is a sectional view taken at line 4—4 in FIG. 2;

DESCRIPTION OF THE PREFERRED EMBODIMENT

Figure 5:
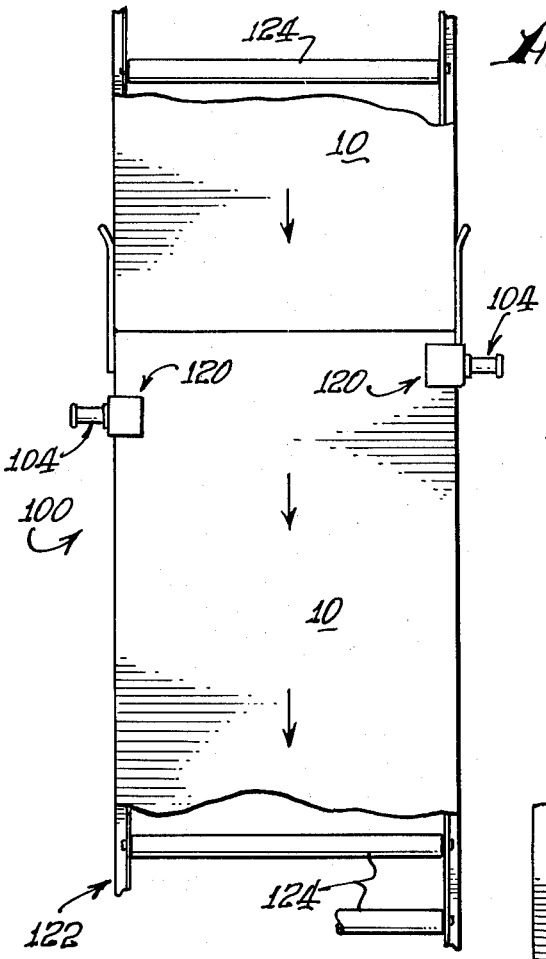
FIG. 5 is a top plane view of a panel indenting or mounting clip installing machine according to the invention.

Turning first to FIGS. 1–4, reference numeral 10 denotes a wall panel, such as a plastic covered gypsum panel, of the kind used to form partitions or walls in office buildings and other structures. A common mounting arrangement for such panels comprises mounting clips 12 secured to the panel along its edges and adapted for engagement with fixed upright support members 14 (only one shown).

Each mounting clip 12 is a sheet metal part of generally channel cross-section including a narrow web portion 16, a flange 18 along one edge of the web portion, and triangular prongs 20 along the opposite edge of the web portion. The flange and prongs are disposed in planes normal to the web portion and spaced a distance approximating one half the width of the panel 10. The width of the flange exceeds the length of the prongs, such that the edge portion of the flange projects beyond the tips of the prongs. Flange 18 has a spring tab 22 which is formed by slitting and bending a portion of the flange, as shown. This tab projects beyond the outer face of the flange.

Support member 14 comprises a channel-like post having a central longitudinal web 24 and flanges 26 joined to the vertical edges of the web. The vertical edges of each post flange turn inwardly toward one another to form lips 28 which are spaced from the flange to define intervening channel-like grooves 30. These grooves slidably receive the edges of panel mounting plates 32 which are slidably adjustable along the post and releasibly retained in adjusted position by dimples 34 in the lips 28. Each mounting plate has an offset portion 36 spaced from the respective post flange 26.

Heretofore, the panel mounting clips 12 were installed on a panel 10 by placing the projecting prongs 20 of a clip against the edge of the panel with the projecting edge portion of the flange 18 seating against the rear side of the panel. The prongs were then simply driven into panel. After installation of the several clips on a panel, the latter is installed by placing the rear side of the panel against the outer sides of a pair of support members or posts 14 with the clip tabs 22 engaging behind the offset portions 36 of the post plates 32 to secure the panel in position.

As noted earlier, the above described panel mounting arrangement and procedure are known. This invention is concerned only with installation of the mounting clips 12 in the wall panels 10. As just mentioned, and noted at the outset, the clips have been heretofore installed by simply forcing or driving their prongs 20 into the panel edges. As the prongs enter the edges, they displaced the panel material toward the sides of the panel, thereby producing unsightly bulges in the panel surfaces, as indicated at 38 in FIG. 2. The present invention avoids the formation of these bulges.

According to the invention, this is accomplished by either first indenting the panel edge with an indenting tool having prongs similar to those of a mounting clip by driving the tool prongs into the edge and then driving the clip prongs into the preformed indentations, or initially driving the clip prongs into the panel edge without indenting the latter, and applying pressure to the sides or faces of the panel during penetration of the tool or clip prongs into the panel edge and opposite the points of penetration by the prongs. This pressure is applied evenly over surface areas of the panel and prevents the panel from bulging due to displacement of the panel material by the entering prongs.

FIGS. 5–8 illustrate a machine 100 for practicing or performing the above mounting clip installation procedure. Machine 100 has a frame 102 mounting actuators 104, in this instance hydraulic actuators. Each actuator has a cylinder 106 firmly attached to a supporting base 108 including a base plate 110. Base plate 110 is adjustably secured to the frame 102 by bolt and slot connections 112. Movable in the cylinder is a plunger or ram 114, the outer end of which is attached to a slide plate 116 disposed in a plane parallel to the ram axis. This axis and plane are horizontal in the illustrated machine.

In addition to the base plate 110, the actuator base 108 includes a pair of parallel upright side plates 117 rising from and firmly attached to the base plate. These side plates are disposed along the longitudinal edges of the slide plate 116 and are grooved to slidably receive the latter plate edges to guide the slide plate in back and forth movement with the actuator ram 106.

Figure 7:
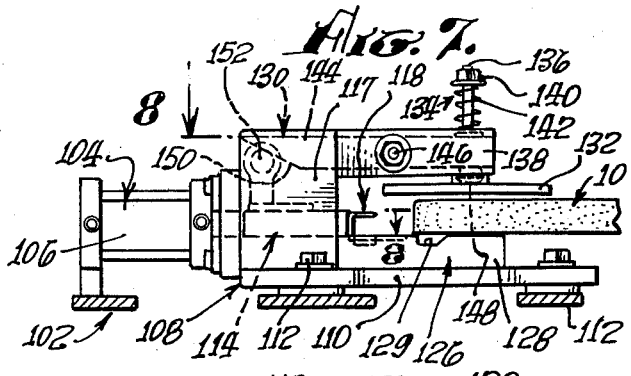
FIG. 7 is a section taken on line 7—7 in FIG. 6.
Figure 8:
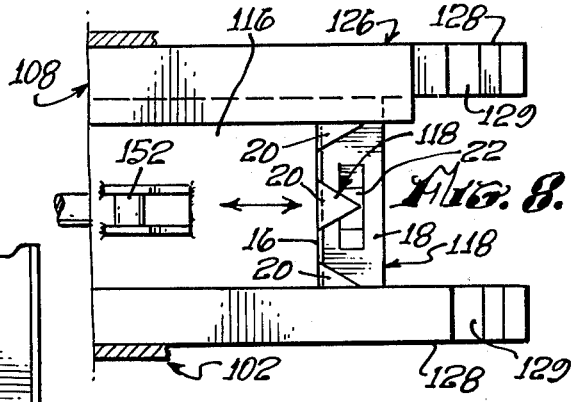
FIG. 8 is a section taken on line 8—8 in FIG. 7.
Figure 6:
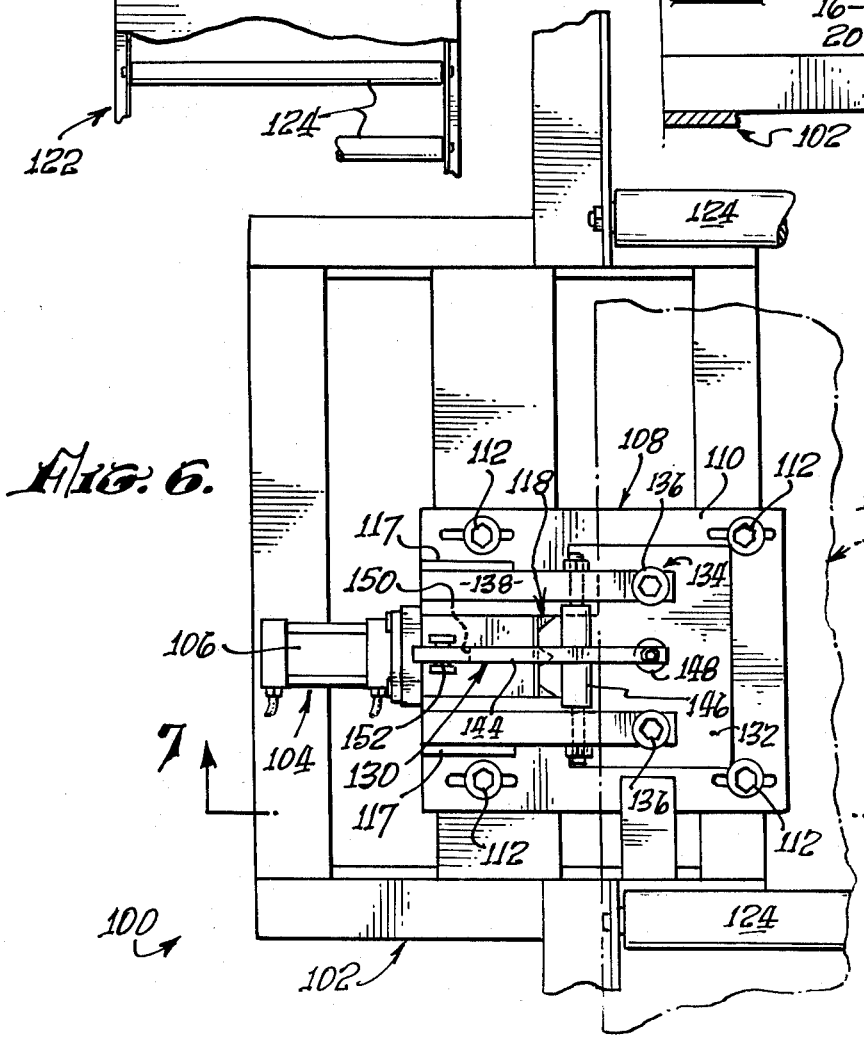
FIG. 6 is an enlarged fragmentary plane view of an indenting or clip installing mechanism of the machine.

Attached to the outer or right hand edge of the slide plate 116 as the latter is viewed in FIGS. 6–8 is an element 118 which may be a tool for indenting the edge of a wall panel 10 to receive a mounting clip 12 in the event the machine is intended to operate as a panel indenting machine, or a panel mounting clip 12 to be installed on a wall panel, in the event the machine is intended to operate as a clip installing tool. As explained below the indenting tool may be a special tool having prongs similar to those of a mounting clip or an actual mounting clip. In this disclosure, it will be assumed for convenience that the tool is a mounting clip. Accordingly, the element 118 will be a mounting clip in both an indenting machine and a clip installing machine. For this reason, the element will be hereafter referred to in places simply as a mounting clip or a clip. The slide plate 116 serves as a drive head for the clip 118 and will be so referred to in places.

Drive head 116 and the actuator 104 together constitute a drive mechanism which functions as an indenting machine and a clip installing mechanism in the clip installing machine. This overall mechanism is designated by the reference numeral 120. As noted earlier and shown in FIG. 5, the machine 10 has a pair of the drive mechanisms 120. These mechanisms are located at opposite sides of the machine frame 102 with their drive heads 116 in a common plane and movable along parallel direction lines.

Frame 102 includes means 122 for supporting a wall panel 10 in the position of FIGS. 5, 6 and 8 wherein the panel is located between the two drive mechanisms 120 and in the common plane of the drive heads 116 of the mechanisms with opposite edges of the panel transverse to the direction lines of movement of the heads and facing the latter. This position of the panel is such that the prongs of the clips 118 on the drive heads are located substantially in a plane bisecting the thickness of the panel. The clip flanges are located lowermost with their upper surfaces in the plane of the under panel surface. The panel supporting means shown comprises conveyor rollers 124 for supporting panels for movement in succession through the position of FIGS. 6 and 8 and supports 126 on which the under side of each panel rests in the latter position. Supports 126 include support bars 128 on the actuator base plates 110 at opposite sides of the drive heads 116 which support the edge portions of the panel. These support bars are notched at 129 for reasons to be explained presently.

During operation of the machine 100 as it is described to this point, wall panels 10 are moved in succession along the frame 102 to the position of FIGS. 6 and 8 between the drive mechanisms 120. These mechanisms are then actuated to extend their drive heads 116 toward the panel. During this extension the prongs of the clip 118 on the head are driven into the panel edges either to indent these edges for subsequent installation of mounting clips 12 or to effect installation of clips in the panel, as explained more fully below. In either case, penetration of the clip prongs into the panel edges displaces the panel material laterally toward the panel surfaces, thereby tending to produce bulges in these faces as explained earlier in connection with FIG. 2. According to the present invention, this bulging of the panel surfaces is avoided by applying pressure to the surfaces adjacent the panel edge portions penetrated by the clip prongs in such a way as to prevent displacement of the panel material at the panel surfaces and thereby formation of surface bulges.

To this end, each drive mechanism 120 is provided with a panel clamping mechanism 130 for applying pressure to the adjacent edge portion of the panel 10 during entrance of the clip prongs into the panel edge. This clamping mechanism comprises a pressure member or plate 132 located above the frame 102 in a position to overlie the panel edge portion and means 134 for effecting extension and retraction of the plate into and from contact with the panel in timed relation to extension and retraction of the respective drive head 116.

Means 134 include bolts 136 attached to the pressure plate 132 and extending loosely through a pair of extending arms 138 on the actuator base side plates 117. Surrounding the upper ends of these bolts between the arms 138 and shoulders 140 on the upper ends of the bolts are compression springs 142 which urge the plate upwardly to its retracted position of FIG. 7, wherein the plate releases the panel 10 for movement to and from its position of the latter figure and FIG. 6.

Pressure plate 132 is extended downwardly into contact with an underlying panel 10 by a rocker arm or lever 144 between the actuator base side plates 117 and arms 138. This lever is pivoted between its ends on the arms 138 by means of a fulcrum shaft 146 for swinging of the lever in a vertical plane parallel to the direction line of movement of the drive head 116. The right hand end of the lever in FIGS. 6 and 7 overlies the center of the pressure plate 132. Mounted on the underside of this lever end is a rounded pressure member 148 which engages the plate to extend the latter downwardly upon clockwise pivoting of the lever in FIG. 7.

The opposite or left hand of the lever 144 is beveled to form a cam surface 150. This cam surface is is engaged by a cam 152 fixed to the upper side of the drive head 116. When the drive head is retracted to its position of FIG. 7, the pressure plate 132 is retained in its upper retracted position of the latter figure by springs 142. Extension of the drive head moves the cam 152 against the cam surface 150 on the lever to rotate the latter clockwise and thereby extend the pressure plate downwardly into contact with an underlying wall panel 10.

From this description, it will be understood that the drive head 116 of each drive mechanism 120 is extendable and retractable to drive the prongs of its clip 118 into the edge of a wall panel 10 in the position of FIGS. 6 and 7, either to indent the edge or install a mounting clip 12 on the panel, as explained shortly. During extension of the drive head, the respective pressure plate 132 is extended downwardly into contact with the upper side of the panel to clamp the latter firmly between the plate and the panel support bars 128 of the respective drive mechanism. The pressure of the plate against the wall panel is exerted directly over the panel edge region penetrated by the clip prongs and prevents bulging of the panel surface by the entering prongs. When the drive head is retracted, the springs 142 retract the pressure plate upwardly to release the panel.

As mentioned earlier, the machine 100 may be used either as an indenting machine to indent the edges of a wall panel 10 to permit subsequent installation of mounting clips 12 on the panel without bulging of its surfaces or as a clip installing machine for installing clips on the panel. If the machine is to operate as an indenting machine, the elements 118 on the drive heads 116 will be panel indenting tools having prongs similar to those of a mounting clip. As mentioned before, this tool may be either a special tool or an actual mounting clip and, in this disclosure, is assumed to be a mounting clip. If the machine is to operate as a clip installing machine, the element 118 will be an actual panel mounting clip 12.

Figure 9:
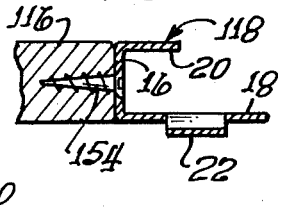
FIG. 9 illustrates a panel indenting tool installed on a drive head.
Figure 10:
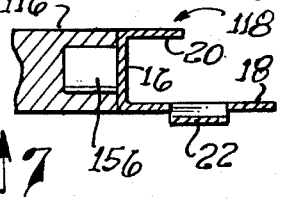
FIG. 10 illustrates a panel mounting clip installed on a drive head.

Turning to FIG. 9, the indenting tools or clips 118 are attached to the front edges of the drive heads 116 by screws 154 which pass through the clip webs 24 and whose heads are countersunk into the web. Mounting clips 12 to be installed on a wall panel are releasibly held to the drive heads by clip magnetic positioning means 156 (FIG. 10).

The operation of the machine 100 is now apparent. Thus, when operating as an indenting machine, indenting tools 118 are attached to the drive heads 116. Wall panels 10 are fed in succession along the frame 102 through the position (indenting position) of FIGS. 6 and 7. The indenting mechanisms 120 are then actuated to extend and retract the drive heads 116 and thereby drive the tool prongs into and from the panel edges to indent the edges. This procedure is repeated at the several locations along the edges where clips are to be later installed. When operating as a clip installing machine, the same operating procedure is followed except that the indenting tools are replaced by mounting clips 12. Conceivably these clips could be fed to the drive heads 116 automatically from clip magazines but, in this disclosure, are assumed to be placed manually on the heads. In this operating mode of the machine, it will be understood that the clip prongs are driven into the panel edges by extension of the drive heads 116. The clips remain in the panel when heads retract. The panel support bars 128 are notched at 129, as mentioned earlier, to clear the clip tabs 22 when the panel is advanced from the position (clip installing position) of FIGS. 6 and 7. Obviously the machine could be automated by providing means for feeding the wall panels to the indenting or clip installing position and operating the drive mechanisms 120 in timed relation to movement of the panels to this position.

I claim:

1. A machine for indenting an edge of a wall panel to receive the prongs of a panel mounting clip, comprising:

a frame, an indenting mechanism on said frame including a drive head for receiving an indenting tool having projecting prongs similar to the mounting clip prongs with the tool prongs disposed in a given plane of said frame and extending parallel to a given direction line in said plane, and actuator means for extending and retracting said drive head parallel to said direction line, means on said frame for supporting a panel in indenting position relative to said mechanism wherein the panel is disposed in said plane with one edge of the panel transverse to said direction line and facing said drive head in a manner such that the prongs of a tool on the head are driven into and retracted from said panel edge to indent the edge by extension and retraction of said head, and means for preventing bulging of said panel sides adjacent the region of penetration of said tool prongs into said panel edge during driving of said tool prongs into said panel edge.

2. A machine for indenting an edge of a wall panel to receive the prongs of a panel mounting clip, comprising:

a frame, an indenting mechanism on said frame including a drive head for receiving an indenting tool having projecting prongs similar to the mounting clip prongs with the tool prongs disposed in a given plane of said frame and extending parallel to a given direction line in said plane, and actuator means for extending and retracting said drive head parallel to said direction line, means on said frame for supporting a panel in indenting position relative to said mechanism wherein the panel is disposed in said plane with one side of the panel resting on said supporting means and one edge of the panel transverse to said direction line and facing said drive head in a manner such that the prongs of a tool on the head are driven into and retracted from said panel edge to indent the edge by extension and retraction of said head, and a panel clamping mechanism in said frame adjacent said mechanism including a pressure member extendable into and retractable from clamping engagement with the other side of the panel adjacent said panel edge to prevent bulging of said panel sides during penetration of said panel edge by said tool prongs, and means for extending and retracting said pressure member in timed relation to extension and retraction of said drive head.

3. A machine according to claim 2 wherein:

said actuator means comprises a longitudinally extendable and retractable ram mounting said drive head, said means for extending and retracting said pressure member comprises means operable by said ram.

4. A machine according to claim 3 wherein:

said ram operable means comprises cam means.

5. A machine for indenting an edge of a wall panel to receive the prongs of a panel mounting clip, comprising:

a frame, an indenting mechanism on said frame including a drive head for receiving an indenting tool having projecting prongs similar to the mounting clip prongs with the tool prongs disposed in a given plane of said frame and extending parallel to a given direction line in said plane, and actuator means for extending and retracting said drive head parallel to said direction line, means on said frame for supporting a panel in indenting position relative to said mechanism wherein the panel is disposed in said plane with one side of the panel resting on said supporting means and one edge of the panel transverse to said direction line and facing said drive head in a manner such that the prongs of a tool on the head are driven into and retracted from said panel edge to indent the edge by extension and retraction of said head, said actuator means comprising a fluid powered actuator including a longitudinally extendable and retractable ram mounting said drive head, and said machine comprising a panel clamping mechanism including a pressure plate over and parallel to said panel supporting means, means supporting said pressure plate on said frame for extension toward said panel supporting means into clamping engagement with the other side of the panel opposite said panel edge to prevent bulging of said panel sides during penetration of said panel edge by said tool prongs and retraction away from said panel supporting means to release the panel, and means including cam and lever means operatively connecting said ram and pressure plate for effecting extension and retraction of said ram and plate in timed relation.

6. A machine according to claim 1 wherein:

said means for preventing bulging of said panel sides comprises means engageable with said panel sides adjacent said region of penetration to resist outward bulging of said panel sides.

7. A machine according to claim 1 wherein:

said means for preventing bulging of said panel sides comprises clamping means for exerting clamping pressure on said panel sides adjacent said region of penetration to prevent outward bulging of said panel sides.

8. A machine according to claim 7 wherein:

panel supporting means comprises conveyor means for feeding panels edgewise in succession through said indenting position.

9. A machine for installing a mounting clip with projecting prongs along an edge of a wall panel, comprising:

a frame, a clip installing mechanism on said frame including drive head for releasibly receiving a mounting clip with the clip prongs disposed in a given plane of said frame and extending parallel to a given direction line in said plane, and actuator means for extending and retracting said head parallel to said direction line, and means on said frame for supporting a panel in clip installing position relative to said mechanism wherein the panel is disposed in said plane with one side of the panel resting on said supporting means and one edge of the panel transverse to said direction line and facing said head in a manner such that the prongs of a clip on the head are driven into said panel edge to secure the clip to the panel by extension of said holder.

10. A machine according to claim 9 including:

a panel clamping mechanism in said frame adjacent said mechanism including a pressure member extendable into and retractable from clamping engagement with the other side of the panel adjacent said panel edge to prevent bulging of said panel sides during penetration of said panel edge by said clip prongs, and means for extending and retracting said pressure member in timed relation to extension and retraction of said drive head.

11. A machine according to claim 10 wherein:

said actuator means comprises a longitudinally extendable and retractable ram mounting said drive head, said means for extending and retracting said pressure member comprises means operable by said ram.

12. A machine according to claim 11 wherein:

said ram operable means comprises cam means.

13. A machine according to claim 9 wherein:

said actuator means comprises a fluid powered actuator including a longitudinally extendable and retractable ram mounting said drive head, and said machine comprises a panel clamping mechanism including a pressure plate over and parallel to said panel supporting means, means supporting said pressure plate on said frame for extension toward said panel supporting means into clamping engagement with the other side of the panel opposite said panel edge to prevent bulging of said panel sides during penetration of said panel edge by said clip prongs and retraction away from said panel supporting means to release the panel, and means including cam and lever means operatively connecting said ram and pressure plate for effecting extension and retraction of said ram and plate in timed relation.

14. A machine according to claim 9 wherein:

said machine comprises a pair of said mechanisms along opposite edges of said panel supporting means for installing clips in opposite edges of said panel

15. A machine according to claim 14 including:

a panel clamping mechanism on said frame adjacent each mechanism including a pressure member extendable into and retractable from clamping engagement with the other side of the panel adjacent said panel edge to prevent bulging of said panel sides during penetration of said panel edge by said clip prongs, and means for extending and retracting said pressure member in timed relation to extension and retraction of said drive head.

16. A machine according to claim 15 wherein:

panel supporting means comprises conveyor means for feeding panels edge wise in succession through said installing position.

17. The method of indenting an edge of a wall panel to receive the prongs of a panel mounting clip comprising the steps of:

selecting a panel indenting tool having prongs similar to the mounting clip prongs, driving said tool prongs endwise into and from said panel edge to indent the edge, and during penetration of said panel edge by said prongs applying pressure to opposite sides of the panel adjacent said panel edge to prevent bulging of the panel sides.

18. The method of installing along one edge of a wall panel a panel mounting clip having projecting prongs comprising the steps of:

driving said clip prongs endwise into said panel edge, and during penetration of said panel edge by said prongs applying pressure to opposite sides of the panel adjacent said panel edge to prevent bulging of the panel sides.

* * * * *

UNITED STATES PATENT OFFICE

CERTIFICATE OF CORRECTION

Patent No. 3,983,775 Dated October 5, 1976

Inventor(s) Alfred A. Moore

It is certified that error appears in the above-identified patent and that said Letters Patent are hereby corrected as shown below:

On the title page, after the Abstract, "18 Claims" should read -- 8 Claims --.

Delete Claims 9 through 18.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*